US009719321B2

(12) United States Patent
Hern et al.

(10) Patent No.: US 9,719,321 B2
(45) **Date of Patent: *Aug. 1, 2017**

(54) SUBTERRANEAN TOOL FOR RELEASE OF BALLS ADJACENT THEIR INTENDED DESTINATIONS

(71) Applicant: Baker Hughes Incorporated, Houston, TX (US)

(72) Inventors: Christopher R. Hern, Kingwood, TX (US); Daniel C. Ewing, Houston, TX (US); Matthew J. Krueger, Houston, TX (US); Jason P. Lacombe, Katy, TX (US); Travis J. Ansohn, Cypress, TX (US); Steve M. Cortez, Katy, TX (US); Michael Ramon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 807 days.

This patent is subject to a terminal disclaimer.

(21) Appl. No.: 14/019,817

(22) Filed: Sep. 6, 2013

(65) Prior Publication Data

US 2015/0068727 A1 Mar. 12, 2015

(51) Int. Cl.

| | |
|---|---|
| ***E21B 33/16*** | (2006.01) |
| ***E21B 23/08*** | (2006.01) |
| ***E21B 34/14*** | (2006.01) |

(52) U.S. Cl.

CPC ..... *E21B 33/16* (2013.01); *E21B 23/08* (2013.01); *E21B 34/14* (2013.01)

(58) Field of Classification Search

CPC ..... E21B 23/00; E21B 23/08; E21B 33/12; E21B 33/16; E21B 34/14

See application file for complete search history.

(56) References Cited

U.S. PATENT DOCUMENTS

| | | | | |
|---|---|---|---|---|
| 2,737,244 | A * | 3/1956 | Baker | E21B 23/06 166/124 |
| 2,776,015 | A * | 1/1957 | Biclstein | E21B 23/02 138/89 |
| 3,850,194 | A * | 11/1974 | Brown | E21B 21/10 137/496 |
| 4,452,322 | A | 6/1984 | Jurgens | |
| 4,491,177 | A * | 1/1985 | Baugh | E21B 33/068 137/268 |
| 4,577,614 | A | 3/1986 | Schoeffler | |
| 6,776,228 | B2 | 8/2004 | Pedersen et al. | |
| 7,100,700 | B2 * | 9/2006 | Davis | E21B 21/10 166/193 |

(Continued)

*Primary Examiner* — Robert E Fuller
*Assistant Examiner* — Christopher Sebesta
(74) *Attorney, Agent, or Firm* — Steve Rosenblatt

(57) ABSTRACT

A subterranean tool can drop multiple objects to landing locations in a tubular string. The tool can keep at least one ball out of the fluid stream until ready for release. A dart or wiper plug can be kept in the fluid stream with an open bypass until axial mandrel movement allows release of the plug or dart. The tool is rotationally locked at a lower location for run in and then can rotationally lock at an upper location upon release of the dart or ball shifting relative rotation capabilities to different members. Axial movement that releases the dart also aligns a ball with a decreasing depth groove so that relative part rotation can cam the ball against a leaf spring detent and into the mandrel flow path.

17 Claims, 5 Drawing Sheets

(56) References Cited

U.S. PATENT DOCUMENTS

| | | | | |
|---|---|---|---|---|
| 7,299,880 | B2 | 11/2007 | Logiudice et al. | |
| 7,770,652 | B2 * | 8/2010 | Barnett | E21B 23/04 137/624.27 |
| 7,802,620 | B2 | 9/2010 | Arce et al. | |
| 2011/0247834 | A1 * | 10/2011 | Gambier | E21B 33/05 166/386 |

* cited by examiner

SUBTERRANEAN TOOL FOR RELEASE OF BALLS ADJACENT THEIR INTENDED DESTINATIONS

FIELD OF THE INVENTION

The field of the invention is subterranean tools that can drop multiple objects in a desired sequence from a location near the intended object landing location or locations.

BACKGROUND OF THE INVENTION

Devices that drop balls and darts are used in a variety of applications. For example in cementing the darts are used to wipe drill pipe clear of cement while dropped balls on seats can be used for allowing building pressure to set tools such as liner hangers/seals that are frequently used in conjunction with equipment for running or setting a liner in existing casing. These devices can be surface mounted on cementing heads for manual or automatic operation by rig personnel or they can be located remotely from a surface location and remotely operated from the surface by fluid flow patterns or remotely actuated detents that can release a potential energy force to launch a ball.

U.S. Pat. No. 4,452,322 shows in FIG. 2 a split view of a ball retained by a sliding sleeve with a flow passage through it. Fluid flow patterns with a j-slot overcome a resisting spring force and ultimately shifts the sleeve to align a port in the sleeve with a ball for gravity release of the ball. U.S. Pat. No. 7,100,700 uses high flow rates to create axial movement to release a ball at a subterranean location that is stored out of the fluid stream until released. Various surface mounted manually operated ball droppers are illustrated in U.S. Pat. No. 6,776,228 where a fork-shaped device straddles a ball and with rotation turns the ball into the flowpath. In U.S. Pat. No. 7,802,620 a handle is turned 180 degrees to cam a ball through an outlet as shown in FIG. 2. Finally, U.S. Pat. No. 4,577,614 shows in FIG. 2 a remotely released detent that allows the potential energy of a spring to push balls out over the bias of a retaining leaf spring.

U.S. Pat. No. 7,299,880 shows a bypass that stays open to allow running of casing without surging the well where the bypass can be closed in the event of a well pressure event.

Some completion assemblies require torque transmitting capabilities and in some applications the ability to drop a ball on a seat if an earlier dropped dart fails to seat so a tool can be set. The present invention combines some of these capabilities by allowing release of a wiper plug with a pickup force. The pickup force allows the plug retainers to pivot to release a dart and at the same time obstruct a flow bypass that allowed flow around the dart before it was released. While running in and until the dart is released the tool components are rotationally locked at a first location and the lock at the first location releases when the plug is launched with an axial pick up force. During the pickup to release the dart a trapped ball in an axial slot in a mandrel is aligned with a mandrel exit hole where relative rotation then can cam the ball toward the exit hole and into the mandrel bore. The released ball can be a backup to set the same tool the dart was intended to set or it can set another tool altogether. The further axial movement to release the ball also engages an upper rotational lock to allow torque transmission for operation of other tools.

Those skilled in the art will more readily appreciate additional aspects of the present invention from a review of the detailed description of the preferred embodiment and the associated drawings while recognizing that the full scope of the invention is to be determined from the appended claims.

SUMMARY OF THE INVENTION

A subterranean tool can drop multiple objects to landing locations in a tubular string. A dart or wiper plug can be kept in the fluid stream with an open bypass until axial mandrel movement allows release of the plug or dart. The tool can also keep an additional ball out of the fluid stream until ready for release by rotation of the mandrel. The tool is rotationally locked at a lower location for run in and then can rotationally lock at an upper location prior to release of the primary dart or ball. The ball is stored in a decreasing depth groove and mandrel slot until axial movement that releases the dart also aligns the ball with a mandrel exit hole so that relative part rotation cams the ball past a leaf spring detent and into the mandrel flow path.

BRIEF DESCRIPTION OF THE DRAWINGS

FIG. 1 is a section view of the tool during running in;

DETAILED DESCRIPTION OF THE PREFERRED EMBODIMENT

Figure 1:
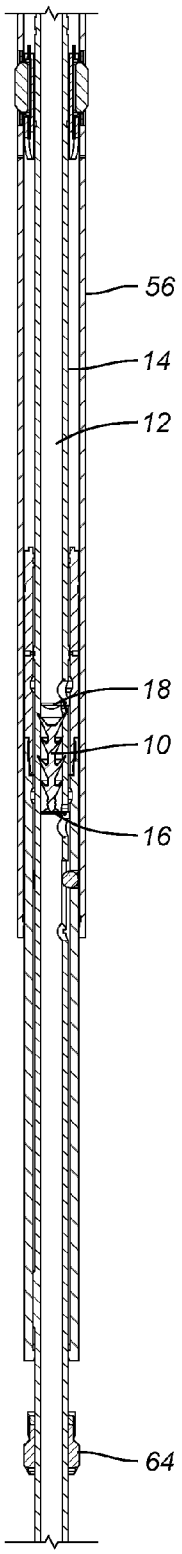
Figure 2:
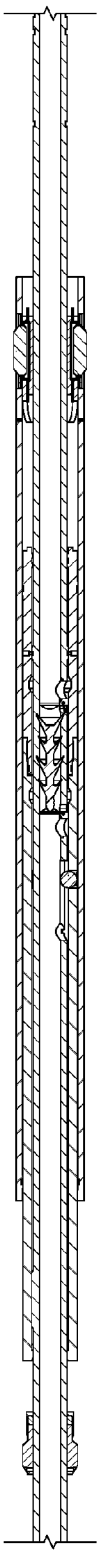
FIG. 2 is the view of FIG. 1 with an initial pickup force and before the dart is released.
Figure 3:
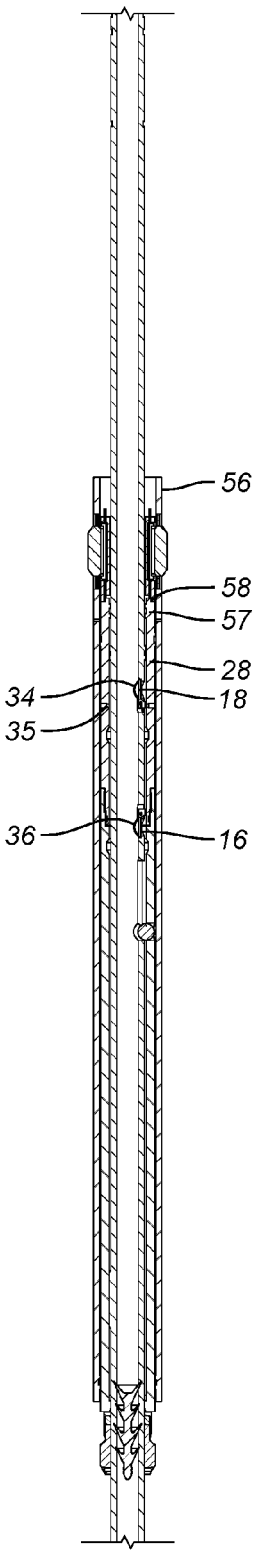
FIG. 3 is the view of FIG. 2 with the dart released from further picking up and the ball aligned with an exit port in the mandrel.
Figure 5:
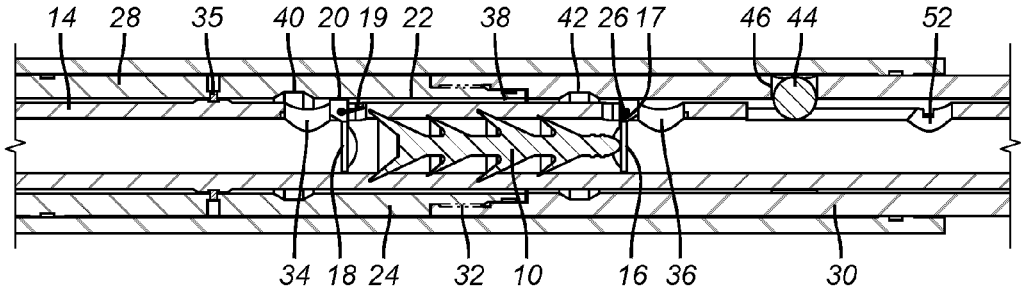
FIG. 5 is an enlarged view of a portion of FIG. 1.
Figure 6:
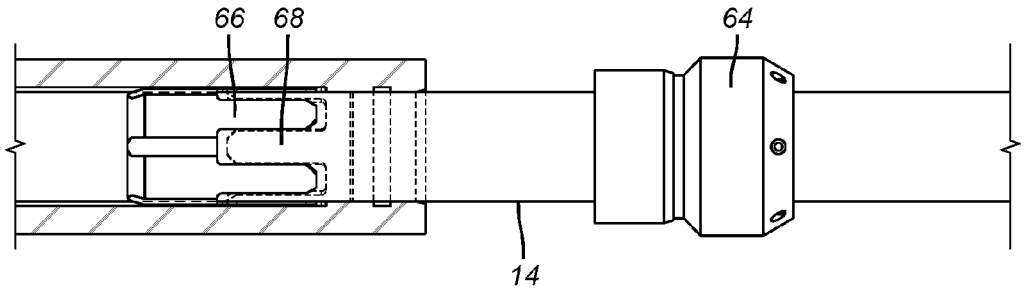
FIG. 6 is a perspective run in view at a lower end of the mandrel showing rotational locking between the mandrel and a surrounding sleeve.
Figure 7:
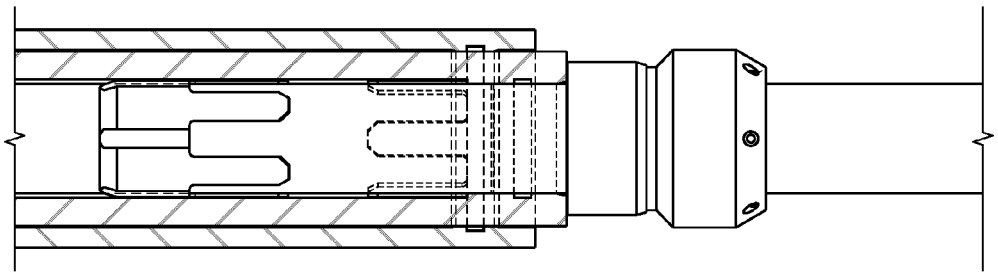
FIG. 7 is the view of FIG. 6 after a pickup force that releases the dart and align the ball with the exit hole showing the release of the lower rotational lock.

Referring to FIG. 1 the relevant portions of the tool are illustrated. In the preferred embodiment a liner that is not shown is being cemented and the dart or wiper plug or ball 10 is supported in the flow path 12 of the mandrel 14 by pivoting retainers 16 and 18. Looking at FIG. 5 for an enlarged view, it can be seen that in the run in position of FIGS, 1 and 5 the pivoting retainers 16 and 18 have an end 20 that abuts surface 22 of the middle sleeve assembly 24 such that rotation about the pivot pin 26 cannot happen. Middle sleeve assembly 24 has an upper member 28 that is connected to lower member 30 at thread 32. Mandrel 14 is pinned to upper member 28 at pin or pins 35 for run in. There is a flow bypass around the plug 10 with an entrance at 34 and an exit at 36 in an annular path 38 between the mandrel 14 and the middle sleeve assembly 24. Upon raising the mandrel 14 the recesses 40 and 42 align with the ends 20 so that the retainers 16 and 18 can both be pivoted by torsion springs 17 and 19 to release the plug 10. The reason for the two retainers 16 and 18 is to hold the plug 10 in position against flow that can come in opposed directions. When the retainer 16 and 18 pivot to the release position that is shown in FIG. 3 it obstructs the exit 36 and entrance 34 respectively sufficiently to let applied pressure and the weight of the plug 10 to start the plug 10 moving downhole until it clears the hole 52 so that the plug can then be pumped the rest of the way to its intended destination downhole.

Figure 10:
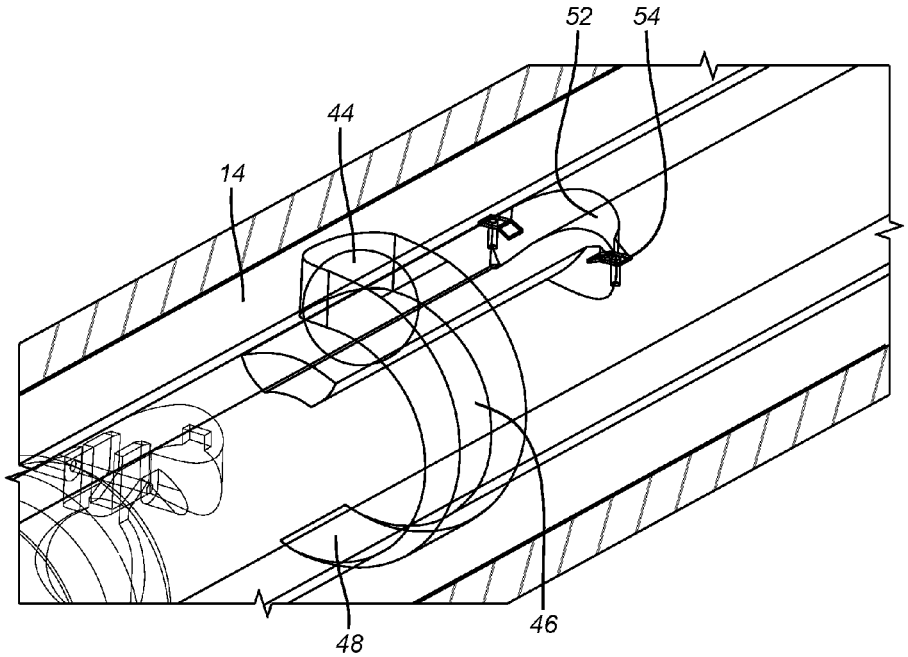
FIG. 10 is a perspective see through run in view showing the ball retained in the groove that has a decreasing radius and in the axial groove in the mandrel in an offset position from the exit hole.
Figure 11:
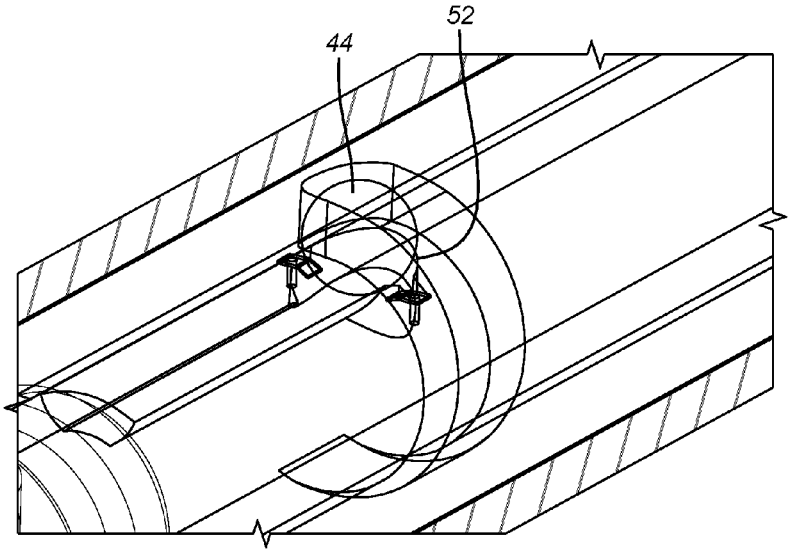
FIG. 11 is the view of FIG. 10 showing alignment of the ball with the mandrel exit hole so that relative rotation is able to cam the ball through the exit hole overcoming a spring detent.
Figure 12:
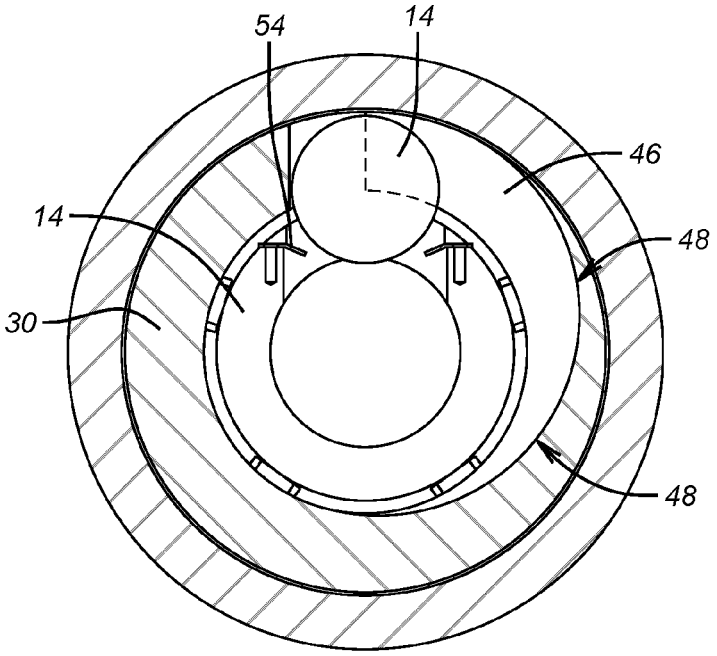
FIG. 12 is the view of FIG. 11 with the ball in the deepest part of the groove before relative rotation has started.
Figure 13:
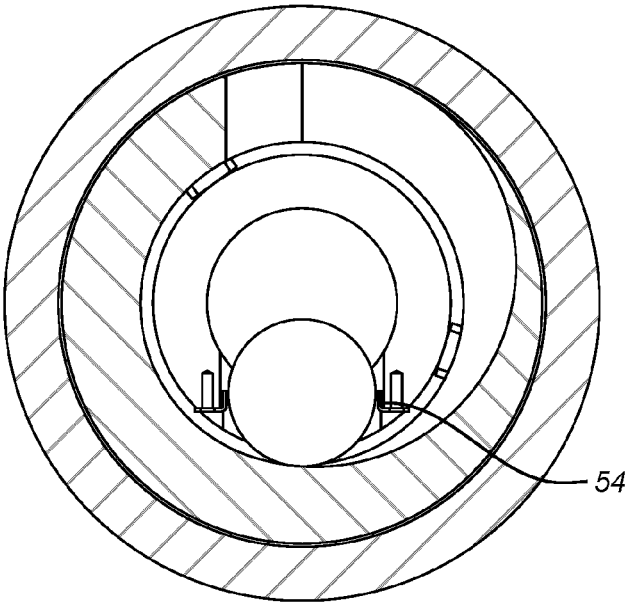
FIG. 13 is the view of FIG. 12 showing how rotation has cammed the ball past the detent so the ball can exit into the mandrel bore.

Also in the run in position there is a ball 44 that is located in a circumferential groove 46 as better seen in FIG. 10. The groove 46 that is located in lower member 30 has a decreasing radius that ends at the bottom surface 48. The ball 44 is initially at an end of an axial slot 50 that terminates in an exit hole 52 that is sized bigger than the diameter of the ball 44. The slot 50 allows the mandrel 14 to be manipulated while the ball 44 is retained substantially within the wall of lower member 30. The slot 50 also allows for the mandrel 14 to be axially shifted within the lower member 30. In addition to the slot 50 on the mandrel 14 and the groove 46 on the lower member 30, there is a spline 66 on the mandrel 14 that meshes with a spline 68 that is internal to the lower member 30. The splines 66 and 68 are engaged for run in to rotationally lock the mandrel 14 to the sleeve assembly 24 in order to not jam the ball 44 in the slot 50. As the mandrel 14 is axially shifted, the splines 66 are disengaged from splines 68 and the ball 44 is shifted into registry with the opening 52 but still retained out of the mandrel passage 12. The ball 44 is retained by a detent 54 that is best seen in FIG. 12 where the ball 44 is shown in the largest diameter of groove 46. It can be seen that relative rotation of the mandrel 14 with respect to the lower member 30 will advance ball 44 along the decreasing radius of bottom surface 48. Since the ball 44 at the time the relative rotation starts is axially aligned with opening 52 the result of the relative rotation will be to cam the ball 44 past the detent 54 allowing the ball to release into passage 12 so it can travel to its ultimate destination further downhole. The detent 54 is shown in FIG. 13 as having been pushed out of the way so that the ball 44 is free to fall into the passage 12 where it can travel by gravity or by being pumped to its end destination on a ball seat (not shown) that can then be used as a backup feature to pressure up and operate the same tool as the plug 10 was supposed to operate or some completely distinct tool can be operated with a landed ball 44.

Figure 4:
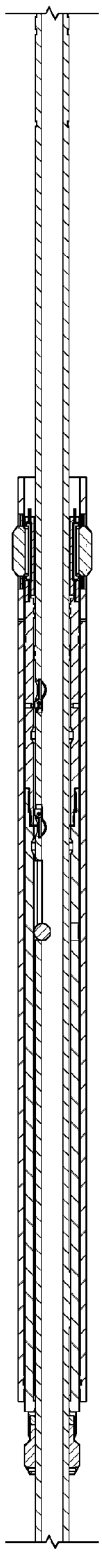
FIG. 4 is the view of FIG. 3 with the ball aligned with an exit port in the mandrel after rotation has cammed the ball into the flow path using a decreasing radius surface.
Figure 8:
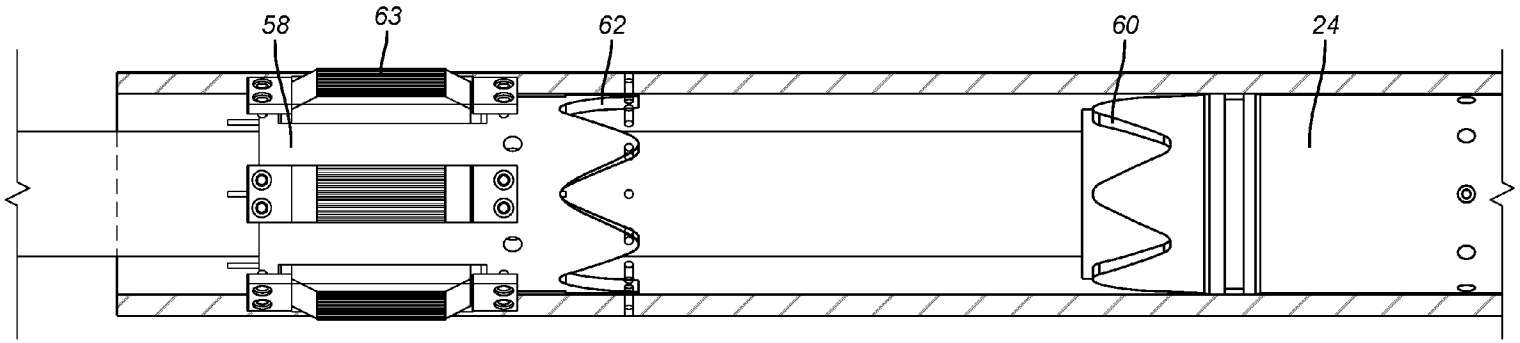
FIG. 8 is a perspective view near the top of the mandrel showing the upper rotational locking feature disengaged.
Figure 9:
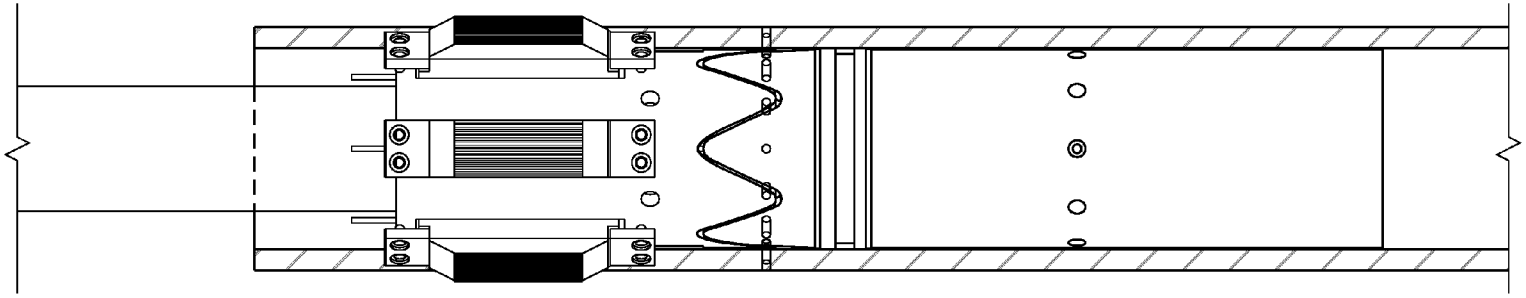
FIG. 9 is the view of FIG. 8 after picking up to release the dart and align the ball with the exit hole showing the upper rotational lock engaged.

Referring back to FIGS. 1-4 the general sequence of operations begin when the outer sleeve 56 is fixed in the wellbore such as with an attached packer or other device that is not shown. Initially the mandrel 14 is restrained to move axially in tandem with the sleeve assembly 24 by the shear pin or pins 35. The mandrel 14 is raised axially until the top end 57 of member 28 hits the drag block housing 58 that is supported by outer sleeve 56 which is in turn otherwise fixed in the wellbore with a packer or anchor that is not shown. When the top end 57 of member 28 hits the drag block housing 58 the teeth 60 and 62 seen in FIG. 8 and FIG. 9 interlock. During the process of teeth 60 and 62 meshing internal mechanisms are triggered in the drag block housing 58 which allow the drag blocks 63 to be released and grip the casing to increase torsional drag. At this point both mandrel 14 and sleeve assembly 24 as well as sleeve assembly 24 and outer sleeve 56 are rotationally locked. Applying additional lifting load on the mandrel will cause the shear pin or pins 35 to break so that the mandrel 14 is no longer restrained to move axially in tandem with the sleeve assembly 24. Once the mandrel 14 and sleeve assembly 24 are no longer locked together several actions take place with two stages of motion of mandrel 14. The first stage of motion of the mandrel 14 is additional axial movement until the travel stop 64 shoulders against the bottom of the lower member 30 of the sleeve assembly 24 seen in FIG. 3. The second stage of motion of the mandrel 14 is rotation seen in FIG. 4. During the first stage of mandrel 14 manipulation three separate actions take place simultaneously. Firstly, the retainers 16 and 18 mounted to respective pivot pins 26 rotate when their respective ends 20 align with the recesses 42 and 40. Secondly, the ball 44 aligns with port 52 so that a subsequent rotation of the mandrel 14 ejects the ball 44 into the passage 12. Thirdly, the splines 66 and 68 release, and the rotational lock between the mandrel 14 and the sleeve assembly 24 is removed. This third action allows the mandrel 14 to have relative rotation within the sleeve assembly 24 and the outer housing 56 enabling the second stage of mandrel 14 manipulations. The second stage of manipulation is made possible because the travel stop 64 against the bottom of the sleeve assembly 24 retains the meshed position of teeth 60 and 62 so sleeve assembly 24 is held fixed as the rotation of mandrel 14 ejects the ball 44 to the passage 12.

Those skilled in the art will appreciate that the present invention allows bringing a plug and a ball or multiple balls close to their ultimate destination before release. The plug that is in the mandrel flow path is bypassed for normal circulation flow and the plug is retained in position against flow in the mandrel passage in either one of two opposed directions. The mandrel is rotationally locked to the surrounding sleeve for run in with splines that separate as the mandrel is picked up. Picking up the mandrel allows the retainers for the plug to pivot out of the way moving them over the bypass ports to aid the plug in its initial movement beyond the bypass so that its own weight or pressure above can deliver the plug to the desired location.

While the mandrel and the surrounding sleeve assembly are initially pinned for tandem movement, picking up the mandrel releases the lower splines between the two and with a bottom travel stop on the mandrel brings the surrounding sleeve assembly to an upper travel limit where teeth mesh to retain the sleeve assembly against rotation while the mandrel can be turned to cam out a ball into the mandrel passage by pushing the ball past a bias and along a decreasing radius arc on a now stationary sleeve assembly and through a port that has come into alignment with the ball as a result of raising the mandrel.

While a single ball is shown as being released additional balls can also be used as well as multiple plugs by just adding additional facilities as those that are described for the ball and plug that are illustrated. While a cement application for a liner hanger is the preferred application, other completion or drilling applications are envisioned. While a plug and ball dropper are illustrated, they can be used separately depending on the application.

The above description is illustrative of the preferred embodiment and many modifications may be made by those skilled in the art without departing from the invention whose scope is to be determined from the literal and equivalent scope of the claims below.

We claim:

1. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel comprising an axial slot leading to at least one wall opening;

wherein in a first position, said mandrel is allowed to move axially without rotation relative to said outer housing;

at least one object stored in said mandrel slot, wherein said axial movement of said mandrel brings said at least one object in alignment with said opening while continuing to retain said least one object, wherein in a second position said object and mandrel rotate in tandem against a surface on said outer housing which cams said at least one object through said wall opening to travel to the adjacent location;

said mandrel extending outside said housing for remote actuation of said mandrel to position said object with respect to said wall opening for discharge therethrough.

2. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel having at least one wall opening;

at least one object initially stored outside said mandrel and selectively positioned to move through said wall opening to travel to the adjacent location;

said mandrel extending outside said housing for remote actuation of said mandrel to position said object with respect to said wall opening for discharge therethrough;

said mandrel is initially rotationally locked to said housing at a first location while free to translate axially relative to said housing.

3. The tool of claim 2, wherein:

relative axial movement of said mandrel with respect to said housing releases said rotational locking at said first location.

4. The tool of claim 2, wherein:

relative axial movement of said mandrel with respect to said housing aligns said wall opening with a circumferential groove in said housing that contains said object.

5. The tool of claim 4, wherein:

said circumferential groove has a decreasing radius surface that cams said object through said wall opening on relative rotation of said mandrel with respect to said housing.

6. The tool of claim 5, wherein:

said wall opening further comprises a detent to retain said object in said wall opening until said relative rotation drives said decreasing radius against said object to overcome said detent.

7. The tool of claim 6, wherein:

said object comprises a sphere.

8. The tool of claim 5, wherein:

said housing further comprises a sleeve assembly;

said circumferential groove is disposed on said sleeve assembly located about said mandrel;

said sleeve assembly initially rotationally locked to said mandrel with meshing splines.

9. The tool of claim 8, wherein:

said mandrel selectively secured to said sleeve assembly with a shearable member for tandem axial movement until said shear member breaks when said sleeve assembly engages said housing.

10. The tool of claim 9, wherein:

said mandrel having a travel stop that engages said sleeve assembly before said shearable member is broken with relative axial movement of said mandrel with respect to said sleeve assembly;

said travel stop pushing said sleeve assembly to rotationally lock with said housing.

11. The tool of claim 10, wherein:

said splines release on relative movement between said mandrel and said sleeve assembly that breaks said shearable member.

12. The tool of claim 11, wherein:

said sleeve assembly having engaging members adjacent an opposed end from said splines to mesh with engaging members on said housing when said travel stop brings said sleeve assembly up axially with said mandrel, said engaging members retain said sleeve assembly as said mandrel is rotated to cam said object, which further comprises a sphere, through said wall opening.

13. A tool for selective release of at least one object from a subterranean location to an adjacent location where said object lands to perform a borehole operation, comprising:

an outer housing with opposed connections for attachment to a tubular string and disposition at a predetermined subterranean location;

a mandrel having a passage therethrough and movably mounted with respect to said outer housing, said mandrel having at least one wall opening;

at least one object initially stored outside said mandrel and selectively positioned to move through said wall opening to travel to the adjacent location;

said mandrel extending outside said housing for remote actuation of said mandrel to position said object with respect to said wall opening for discharge therethrough;

said housing further comprises a sleeve assembly disposed about said mandrel;

said mandrel further comprises a second object selectively retained in said passage;

said mandrel and said sleeve assembly defining a flow bypass around said second object when said second object is supported in said mandrel passage;

said second object released from said mandrel passage by relative movement between said mandrel and said sleeve assembly.

14. The tool of claim 13, wherein:

said second object retained by at least one pivoting support in said mandrel passage that is prevented from pivoting to release said second object until relative axial movement between said mandrel and said sleeve assembly.

15. The tool of claim 14, wherein:

said pivoting support pivots as a result of a recess on said sleeve assembly aligning with an end of said pivoting support to allow rotation of said pivoting support.

16. The tool of claim 15, wherein:

said flow bypass is defined by spaced mandrel apertures that straddle said second object;

at least one said pivoting support comprises at least two pivoting supports so that each said aperture has an adjacent pivoting support;

at least one of said pivoting supports pivots to at least partially obstruct an adjacent aperture.

17. The tool of claim 16, wherein:

said second object is a dart or wiper plug or ball.

* * * * *